United States Patent [19]

Denman et al.

[11] Patent Number: 4,934,661

[45] Date of Patent: Jun. 19, 1990

[54] INERTIAL BARRIER ARRAY

[75] Inventors: Owen S. Denman, Roseville; William G. Krage, Fair Oaks, both of Calif.

[73] Assignee: Energy Absorption Systems, Inc., Chicago, Ill.

[21] Appl. No.: 332,234

[22] Filed: Mar. 31, 1989

[51] Int. Cl.[5] ..... E01F 15/00

[52] U.S. Cl. ..... 256/13.1; 256/1

[58] Field of Search ..... 256/13.1, 1; 404/6

[56] References Cited

U.S. PATENT DOCUMENTS

| | | | |
|---|---|---|---|
| Re. 29,544 | 2/1978 | Fitch . | |
| 3,141,655 | 9/1964 | Platt | 256/13.1 X |
| 3,666,055 | 5/1972 | Walker et al. . | |
| 4,073,482 | 2/1978 | Seegmiller et al. . | |
| 4,101,115 | 7/1978 | Meinzer . | |
| 4,183,504 | 1/1980 | Ford . | |
| 4,289,419 | 9/1981 | Young et al. . | |
| 4,557,466 | 12/1985 | Zucker | 256/13.1 |
| 4,688,766 | 8/1987 | Zucker . | |

OTHER PUBLICATIONS

Energite Maintenance Manual–Form No. ENE425-10-84–Energy Absorption Systems (no date).

*Primary Examiner*—Andrew V. Kundrat

[57] ABSTRACT

An array of inertial barriers positioned on a support surface alongside a vehicle roadway includes a number of separate containers, each having an outer wall and a lower portion. An inner core is positioned within each container to define an annular space between the core and the respective outer wall. This annular space defines an average inner diameter which is at least about 20% of the average outer diameter of the annular space. A dispersible material such as sand is disposed in the annular spaces such that no more than 10% of the mass of sand in any container of the array extends in an uninterrupted disc across the respective container.

16 Claims, 4 Drawing Sheets

INERTIAL BARRIER ARRAY

BACKGROUND OF THE INVENTION

This invention relates to an improved array of inertial barriers of the type used alongside a roadway to decelerate a vehicle that has left the roadway.

Inertial highway barriers have been used for some time to prevent vehicles from striking an obstacle such as a bridge pier or the like at full velocity. An inertial barrier relies on the mass of the barrier to decelerate the vehicle. Typically, a dispersible material such as sand is enclosed in a frangible container. When the vehicle strikes the container, the momentum of the impacting vehicle is dissipated in accelerating the sand.

Early uses of inertial barriers are disclosed in Fitch U.S. Pat. No. Re 29,544 and Ford U.S. Pat. No. 4,183,504. In these barriers the mass of sand is elevated above the roadway on a platform in an attempt to match the heights of the centers of gravity of the barrier and the impacting vehicle. In this way, the tendency of the impacting vehicle to be accelerated vertically (either up or down) by the barrier is minimized. Later approaches have used other structures to elevate the center of gravity of the dispersible mass. For example, Seegmiller U.S. Pat. No. 4,073,482 discloses barriers having sand in a wine glass shape. Young U.S. Pat. No. 4,289,419 discloses an inertial barrier system wherein a central void is provided in the lower part of the barriers. Zucker U.S. Pat. Nos. 4,688,766 and 4,557,466 disclose inertial barriers wherein an insert is used to elevate the center of gravity of the lighter weight barriers.

In all of the inertial barriers discussed above, the more massive barriers include a substantially monolithic block of dispersible material. This configuration causes the mass per unit of height of the barrier to be relatively large. For this reason, a mismatch of only a few inches between the elevations of the centers of gravity of the barrier and the impacting vehicle can result in undesirably large vertical accelerations being imparted to the vehicle. Note for example the substantially solid masses of sand shown in the barriers of FIGS. 3*a* and 3*b* of the Zucker patents, in the 1400 pound barriers of the Young patent, and in all of the barriers of the Seegmiller, Fitch and Ford patents. This configuration can represent an unnecessary hazard to an impacting vehicle if the sand is wet and frozen. In this case, the monolithic block of sand is no longer easily dispersible, and it can cause unacceptably large decelerations to the vehicle. Additionally, unacceptably large blocks of frozen sand may be accelerated by the vehicle, and these accelerated blocks may present hazards to bystanders.

Of course, it should be recognized that not all highway barriers are inertial barriers. Another class of barriers relies on a fixed support for the barrier, and this support may be either horizontally or vertically oriented. Such barriers are secured to the support such that it is not the inertia of the barrier itself that provides the principal decelerating force. Note for example the energy absorbing devices shown in Walker U.S. Pat. No. 3,666,055, Meinzer U.S. Pat. No. 4,101,115, and Platt U.S. Pat. No. 3,141,655. Platt in FIG. 6 shows an energy absorbing device that includes an annulus of sand 28. The entire device is secured to a concrete base 14 by a tension rod 30. Because the Walker, Meinzer and Platt energy absorbing devices are not inertial barriers, they are of limited application to the present invention.

It is a primary object of this invention to provide an inertial barrier array that provides reduced vertical accelerations to an impacting vehicle, in spite of variations in the height of the center of gravity of the impacting vehicle.

It is a further object of this invention to provide an inertial barrier array which reduces or eliminates solid masses or discs of dispersible material extending completely across the barriers of the array.

It is yet a further object of this invention to provide an improved inertial barrier array in which each of the barriers of the array has improved water drainage characteristics.

SUMMARY OF THE INVENTION

According to this invention, an array of inertial barriers is provided on a support surface alongside a vehicle roadway. This array comprises a plurality of frangible containers arranged along an axis, wherein each of the containers comprises an outer wall and a lower portion. An inner core is disposed in each of the containers and defines an annular space between the core and the respective outer wall. This annular space defines an average inner diameter which is at least about 20% of the average outer diameter of the annular space. A mass of dispersible material is disposed in each of the annular spaces such that each of the masses in the entire array of inertial barriers is substantially annular in shape with no more than about 10% of any of the masses in the array extending in an uninterrupted disc across the respective container.

Preferably, the barriers are graduated in mass, with less massive barriers situated at one end of the axis. Most preferably, the average inner diameter is at least about 40% of the average outer diameter for each of the annular spaces, and drainage holes are provided in the frangible containers to drain water from the dispersible masses. Preferably, each of the inner cores passes completely through the respective dispersible mass from top to bottom such that each of the dispersible masses is annular in configuration.

As pointed out below, the preferred embodiments of this invention entirely eliminate solid discs of sand extending completely across the container. This reduces vertical accelerations imparted to an impacting vehicle over a wide range of vehicle heights. In addition, it improves the drainage of water from the sand, and it reduces the likelihood that a large block of sand will be accelerated as a monolithic mass during an impact.

The invention itself, together with further objects and attendant advantages, will best be understood by reference to the following detailed description, taken in conjunction with the accompanying drawings.

DETAILED DESCRIPTION OF THE PRESENTLY PREFERRED EMBODIMENTS

Turning now to the drawings, FIGS. 4–7 show two separate arrays of inertial highway barriers that embody the present invention. Before turning to these figures, details of construction of the individual barriers will be described in conjunction with FIGS. 1–3*e*.

Figure 1:
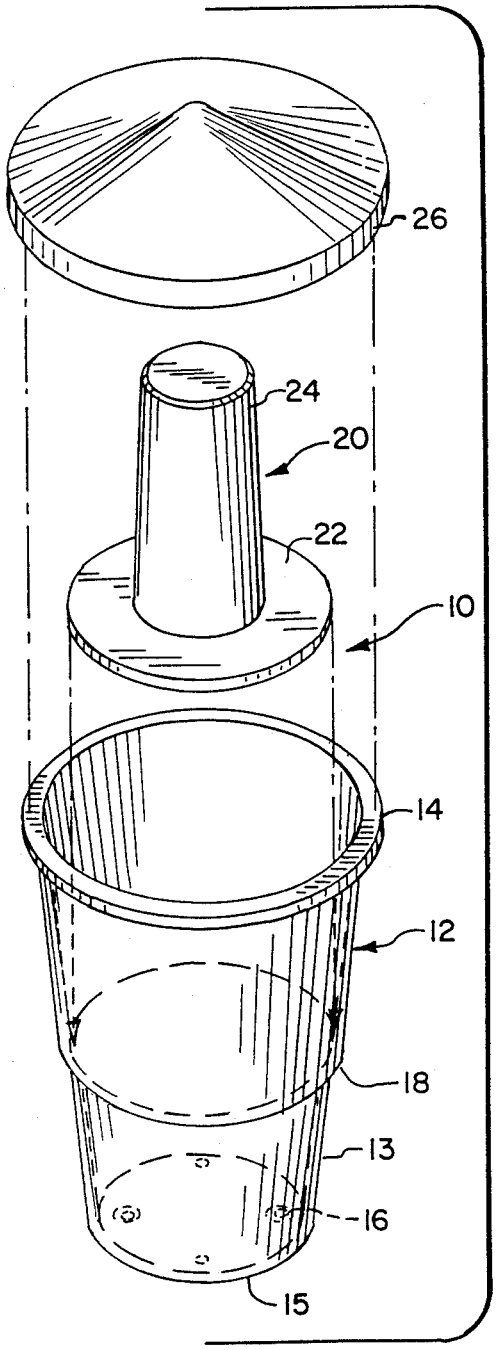
FIG. 1 is an exploded perspective view of a first highway inertial barrier included in the presently preferred embodiment of this invention.

FIG. 1 shows an exploded perspective view of a first inertial barrier 10. This barrier 10 includes a container 12 which includes a peripheral sidewall 13 which terminates at its upper end in an annular lip 14 and at its lower end in a bottom panel 15. The bottom panel 15 is provided with an array of drain holes 16, and the sidewall 13 defines a shoulder 18 at an intermediate position.

The barrier 10 also includes an inner core or insert 20 that includes an annular flange 22 and a cylindrical or frusto-conical upper section 24. The flange 22 is positioned to rest on the shoulder 18 to support the insert 20 in place, and the flange 22 has sufficient structural rigidity to support a mass of dispersible material such as sand in the annular space between the upper section 24 and the sidewall 13.

Finally, the barrier 10 includes a lid 26 which is designed to engage the lip 14 to securely hold the lid 26 in place.

Figure 2:
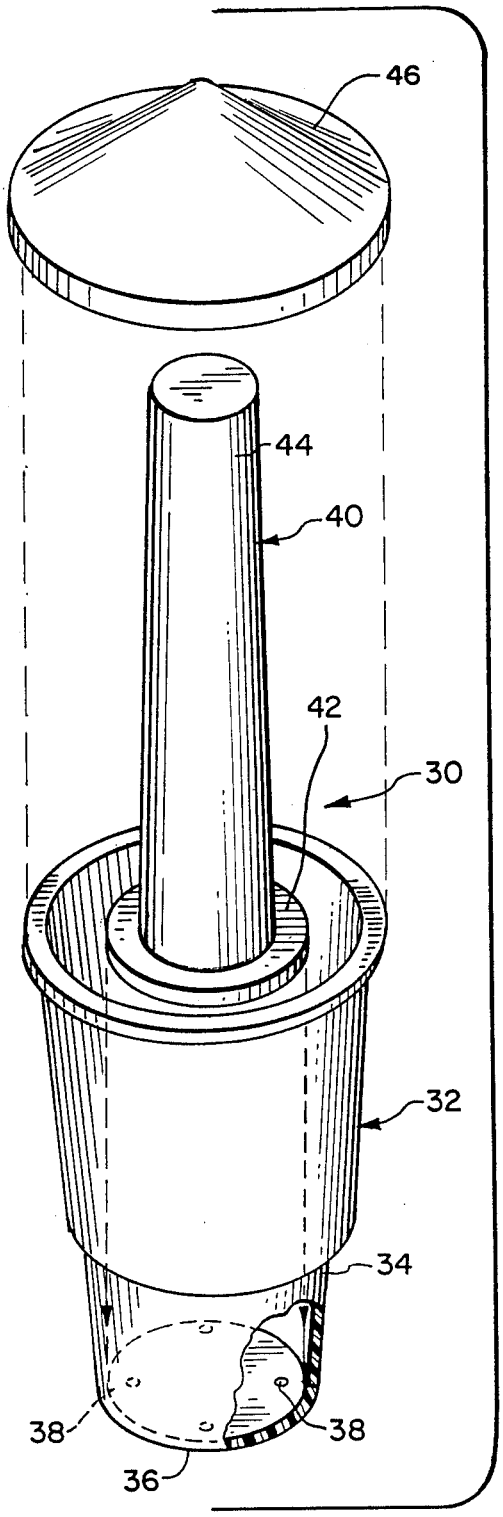
FIG. 2 is an exploded perspective view of a second highway inertial barrier included in this embodiment.

FIG. 2 shows an exploded perspective view of a second barrier 30 which is generally similar to the barrier 10 described above. The barrier 30 includes a container 32 having a sidewall 34, a bottom surface 36, and drain holes 38. The container 32 is similar to the container 12, but is somewhat higher in overall height. The barrier 30 includes an insert 40 having an annular flange 42 and a frusto-conical upper section 44. The insert 40 is designed to rest on the bottom surface 36 and to create an annular space between the upper section 44 and the sidewall 34. This annular space is intended to receive a dispersible material such as sand when the barrier is fully assembled. Finally, the barrier 30 includes a lid 46 which is similar to the lid 26 described above, but may be more steeply angled as shown in FIG. 2. The container 32 is shown as defining a flange in the side wall, but this feature may readily be deleted if desired.

Figure 3A:
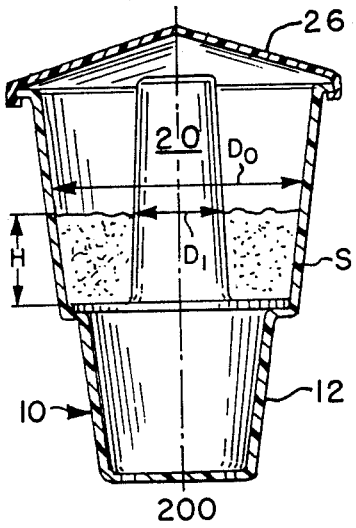
FIGS. 3–3*e* are five sectional views of inertial barriers included in the array of FIGS. 4 and 5.
Figure 3B:
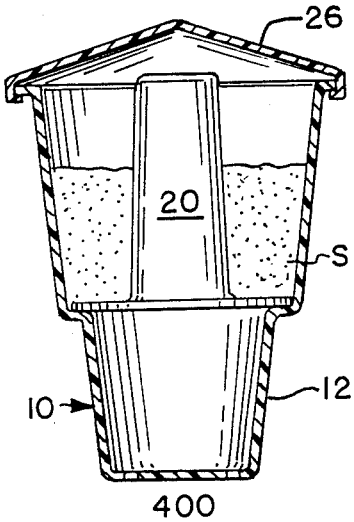
Figure 3C:
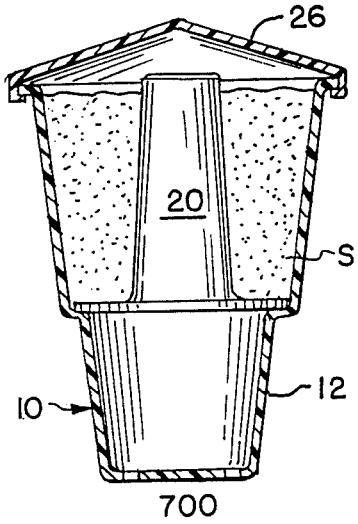

The arrays of barriers shown in FIGS. 4–7 include a number of separate barriers. In particular, the array of FIGS. 4 and 5 includes barriers of five different masses; FIGS. 3*a*–3*e* provide cross-sectional views of these five different barriers. The barriers of FIGS. 3*a*, 3*b* and 3*c* are identical in structure with the barrier 10 shown in FIG. 1, but each contains a different quantity of sand S. The barriers of FIGS. 3*a*, 3*b* and 3*c* have a sand mass of 200, 400 and 700 pounds, respectively.

As shown in FIG. 3*a*, the annular space occupied by the sand defines an average inner diameter $D_I$ and an average outer diameter $D_O$. Preferably, the average inner diameter $D_I$ is at least about 20% of the average outer diameter $D_O$, and most preferably the average inner diameter $D_I$ is at least about 40% of the average outer diameter $D_O$.

Figure 3D:
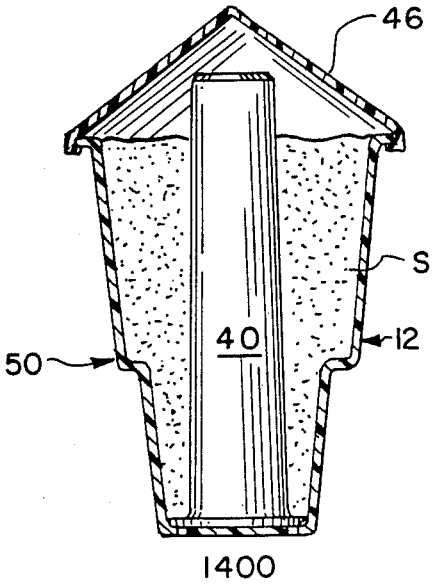

FIG. 3*d* shows a more massive barrier 50 having a weight of 1400 pounds. The barrier 50 is made up of a mix of the parts described above. In particular, the container is the shorter container 12 of FIG. 1 while the insert 40 and the lid 46 are as shown in FIG. 2. Because in this embodiment the lid 46 is more steeply angled, the container 12 can be used with the insert 40. Of course, in alternate embodiments the angle of the lid can be varied as desired.

Figure 3E:
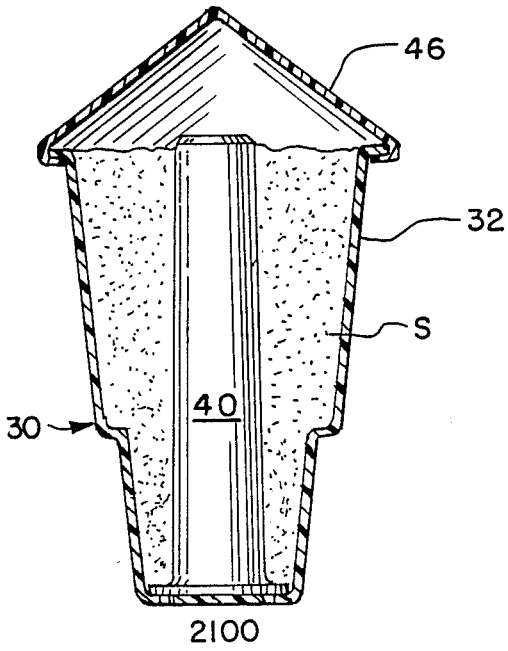

Finally, FIG. 3*e* shows the distribution of sand in the barrier 30 of FIG. 2. Preferably, the centers of gravity of all five of the barriers are at approximately the same height (within a range of about five inches), and this height matches that of the center of gravity of the average impacting vehicle for which the barriers are designed.

FIGS. 3*a*–3*e* illustrate a number of important features of the inertial barriers 10, 30, 50. First, in all cases the insert 20, 40 extends completely through the mass of sand S such that the mass of sand S has an annular configuration at any cross-section. It is not essential in all embodiments of this invention that the insert 20, 40 pass completely through the mass of sand S, but in general it is preferred that less than 10% of the mass of sand S be disposed in an uninterrupted disc passing completely across the container 12, 32.

This configuration for the sand provides several important advantages. First, because the insert 20, 40 occupies a considerable volume, the sand S for a given weight is distributed over a larger vertical distance H (FIG. 3*a*). For this reason, the mass per unit height (M/H), is reduced with the inertial barriers of FIGS. 3*a*–3*e* as compared to an inertial barrier in which the sand is compacted into a monolithic volume as in the Fitch patent described above. By reducing M/H, the barriers of FIGS. 3*a*–3*e* operate more reliably when there is a mismatch between the height of the centers of gravity of the barrier and the impacting vehicle. In general, impacting vehicles will have centers of gravity at a range of heights, and it is therefore not possible for any one barrier to have a center of gravity at the correct height for every vehicle. However, by minimizing M/H, the barriers of FIGS. 3*a*–3*e* minimize the vertical forces applied to the impacting vehicle for any given disparity in the heights of the centers of gravity.

A second important advantage is that because the sand is disposed completely in an annular space, there is more of a tendency for the sand to be broken into small pieces during an impact. The containers 12, 32 are frangible and are designed to break apart during an impact. In the event the sand is wet and frozen, a monolithic block of sand can result in undesirably large blocks of frozen sand being accelerated away from the impact. The configurations of FIGS. 3*a*–3*e* provide a central void in the mass of sand in each case. This promotes break-up of any frozen sand into manageable sizes during an impact.

Yet a third advantage is improved drainage provided by the configurations of FIGS. 3*a*–3*e*. These configurations result in increased vertical height of sand for given mass as compared to a monolithic body of sand. This increased vertical height increases the pressure of water at the bottom of the column of sand, and thereby increases the efficiency with which water is drained via the drainage holes 16, 38. In this regard, it is important that the fit between the insert 20 and the shoulder 18 and the fit between the insert 40 and the bottom surface 36 be sufficiently loose as to allow adequate drainage.

Figure 4:
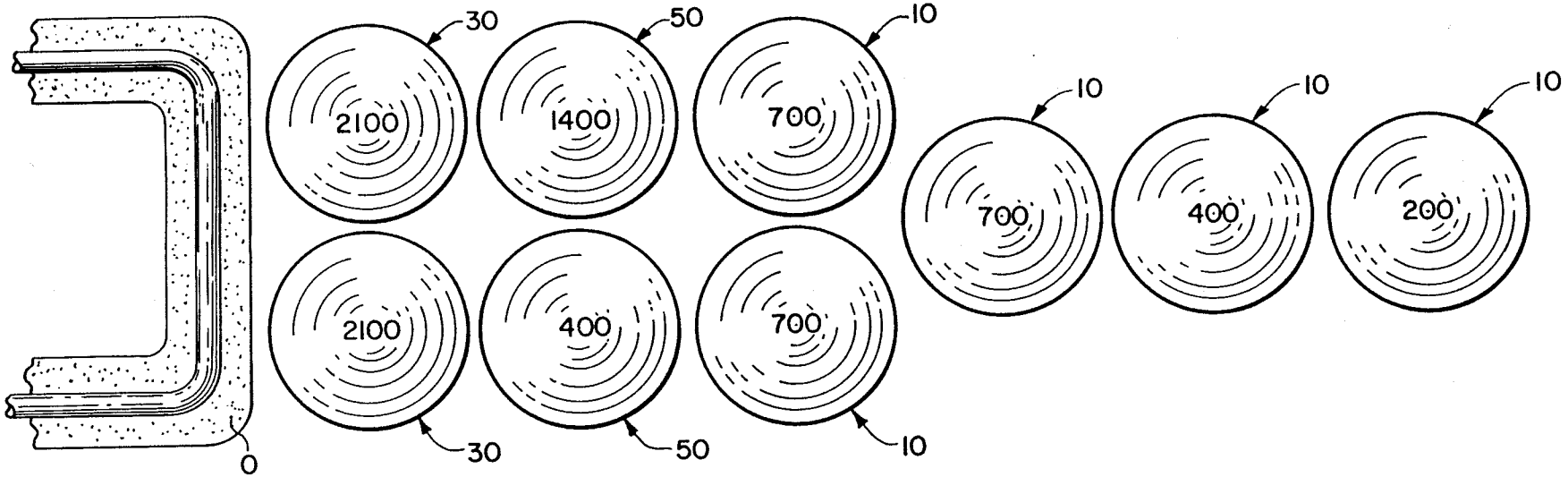
FIG. 4 is a plan view of a first preferred embodiment of the inertial barrier array of this invention.
Figure 5:
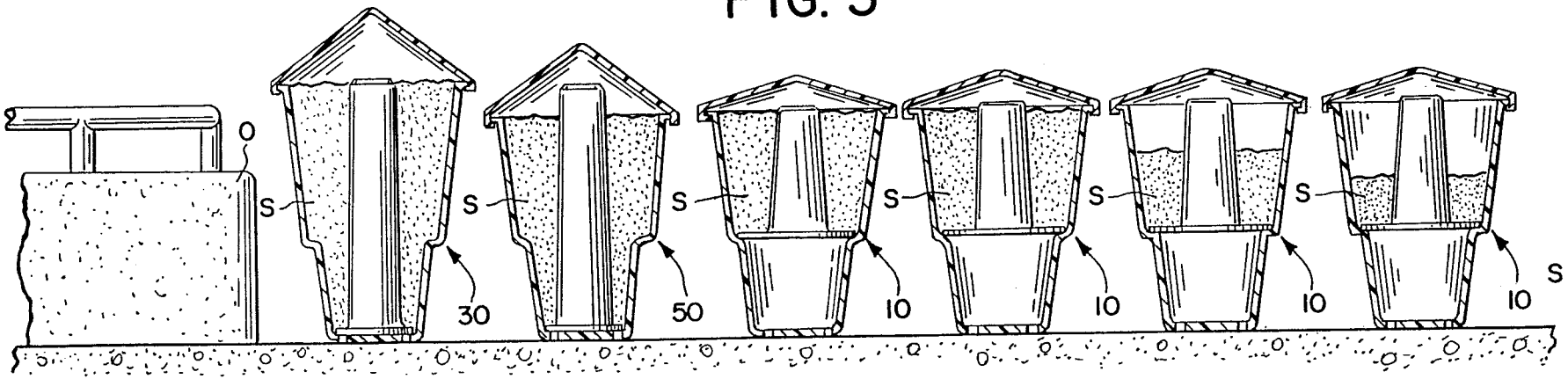
FIG. 5 is an elevational view in partial cutaway of the array of FIG. 4.

Turning now to FIGS. 4 and 5, these figures show one preferred embodiment of an array of the inertial barriers described above. As shown in FIGS. 4 and 5, the barriers 10, 30, 50 are freely supported on a support surface SS without tension members or other means for tying the barriers in place on the support surface SS. The barriers 10, 30, 50 are arranged in an array alongside a roadway in front of an obstacle O. The barriers 10, 30, 50 are arranged along an axis extending away from the obstacle O with the lighter weight barriers at one end and the heavier weight barriers at the other, near the obstacle O. In this case, the most massive barrier 50 has a weight in excess of 2,000 pounds. As shown in FIG. 5, each of the barriers in the array includes a respective mass of sand S that is annular in shape, with the respective insert 20, 40 extending completely from the top to the bottom through the mass of sand.

Figure 6:
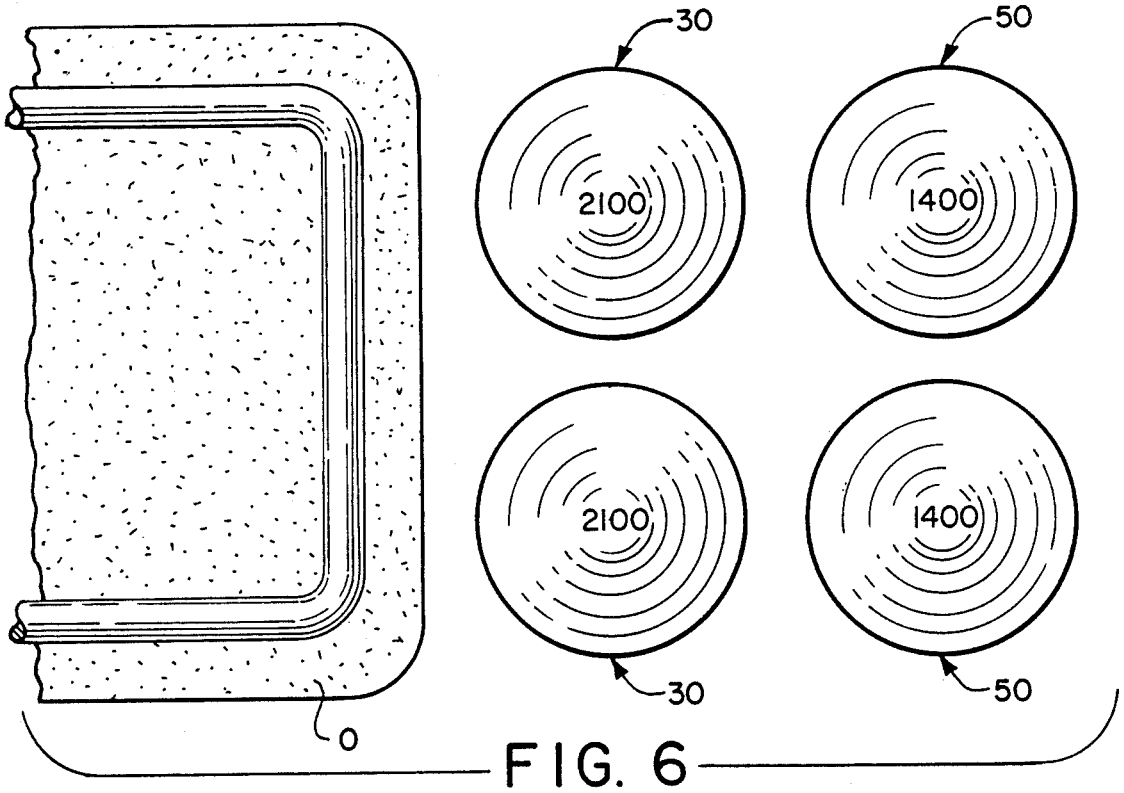
FIG. 6 is a plan view of a second preferred embodiment of the inertial barrier array of this invention.
Figure 7:
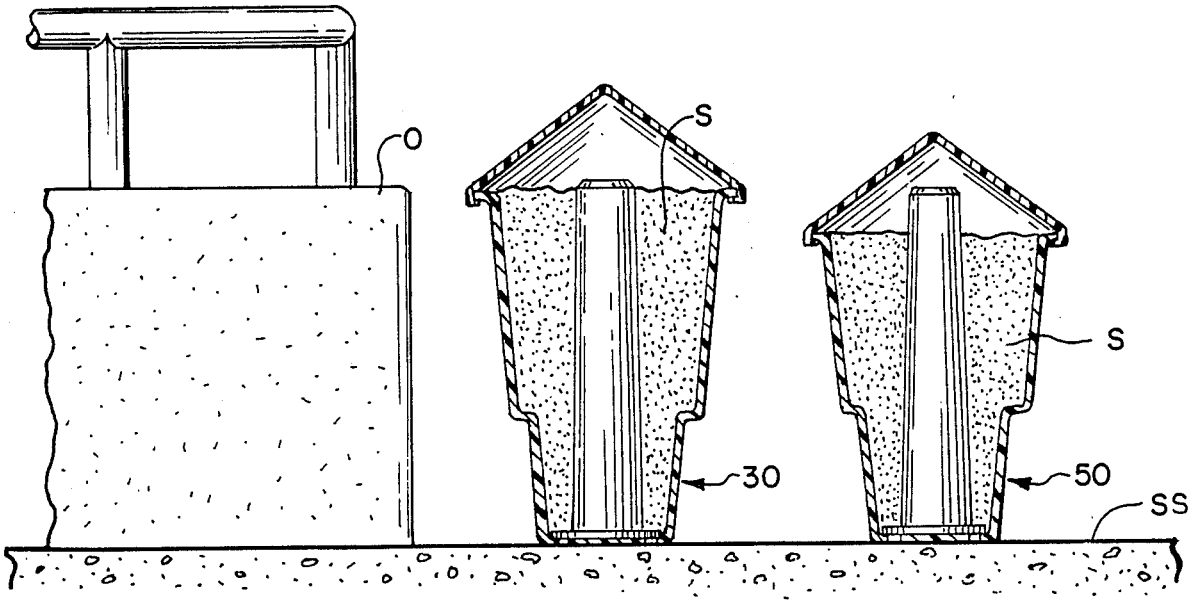
FIG. 7 is an elevational view in partial cutaway of the array of FIG. 6.

Of course, this invention is not limited to arrays of the precise configuration shown in FIGS. 4 and 5, and it can easily be adapted to either larger or smaller arrays. FIGS. 6 and 7 show one smaller array made up of four inertial barriers 30, 50. Once again, the barriers are progressively heavier in weight near the obstacle O, and are freely supported on a support surface SS.

The preferred embodiments described above provide the advantage of minimizing the total number of component parts required to make up the separate barriers. However, this is not required in all applications, and each barrier may have a distinctive container, insert and lid if desired.

The following details of construction are provided in order better to define the presently preferred embodiments of this invention. It should be clearly understood that these details are not intended to be limiting in any way, and that other materials, dimensions, specifications and fabrication techniques can be used if desired.

The lids 26, 46 can be rotationally molded of a high, low, or medium density polyethylene resin. The lid should preferably have the properties set out in Table I.

The container 12, 32 can also be rotationally molded of a high density polyethylene (H.D.P.E.) using a resin such as that available under the tradename Chemplex 5305 or Allied 7002. The materials listed in Table II can be used in a three-layer system having a center layer of foamed H.D.P.E. and inner and outer layers of non-formed H.D.P.E.. In each case, the various quantities of H.D.P.E., UV Stabilizers and foaming agent are dry blended for a minimum of 20 minutes using a sigma blade mixer. The resulting three layer container should preferably have the physical characteristics set out in Table III. Of course, a three-layer wall is not required for the container 12, 32, and it may be preferable in some applications to use two layers: a foamed inner layer approximately 3/16" in thickness and an unfoamed outer layer approximately 1/16" in thickness.

The insert 20, 40 can also be rotationally molded of H.D.P.E. such as that described above. The H.D.P.E. is preferably combined with an ultraviolet stabilizer such as 0.45 grams per pound of TINUVIN 770 and TINUVIN 327. The resulting insert preferably has the physical properties set out in Table IV.

Of course, it should be understood that a wide range of changes and modifications can be made to the preferred embodiments described above. It is therefore intended that the foregoing detailed description be regarded as illustrative rather than limiting, and that it be understood that it is the following claims, including all equivalents, which are intended to define the scope of this invention.

TABLE I

| Property (Units) | Test Method | Value |
|---|---|---|
| Tensile strength (PSI) | ASTM-D-638 | 2400 Min |
| Elongation (%) | ASTM-D-638 | 200 Min |
| Brittleness Temp (°F.) | ASTM-D-746 | −40 Lower Limit |
| Density (gm/cc) | ASTM-D-1505 | .930–.950 |
| Low Temperature Impact Resistance | ARM Falling Dart Severity Test (5 lb dart with ½" radius nose, 3 ft drop, 72° F.) | No fracture |

TABLE II

| | CONTAINER CONSTRUCTION |
|---|---|
| Outer Layer: | 7½ +/− .25 lb. H.D.P.E. |
| U.V. Stabilizer: | .64 gm/lb TINUVIN 770 +/− .05 gm/lb. |
| | .64 gm/lb TINUVIN 327 +/− 0.5 gm/lb. |
| Middle Layer: | 9 +/− .25 lb. H.D.P.E. |
| Foaming Agent: | 3.7 gm/lb CELOGEN AZ-130 |
| U.V. Stabilizer: | .50 gm/lb TINUVIN 770 +/− .05 gm/lb. |
| | .50 gm/lb TINUVIN 327 +/− .05 gm/lb. |
| Inner Layer: | 5½ +/− lb. H.D.P.E. |
| U.V. Stabilizer: | .64 gm/lb TINUVIN 770 +/− .05 gm/lb. |
| | .64 gm/lb TINUVIN 327 +/− .05 gm/lb. |

TABLE III

| Property (Units) | Test Method | Value |
|---|---|---|
| Tensile Strength (PSI) | ASTM D-638 | 1400 +/− 200 |
| Elongation (%) | ASTM D-638 | 200 min. |
| Low Temperature Impact Resistance | ARM Falling Dart Test (5 lb dart with ½" radius nose, 2 ft. drop, 72° F.) | Fracture |

TABLE IV

| Property (Units) | Test Method | Value |
|---|---|---|
| Tensile Strength (PSI) | ASTM-D-638 | 3300 +/− 350 |
| Elongation (%) | ASTM-D-638 | 200 Min |
| Density (gm/cc) | ASTM-D-1505 | .950–.960 |
| Brittleness Temp. (°F.) | ASTM-D-746 | −100 Lower Limit |
| Low Temperature Impact Resistance | ARM Falling Dart Severity Test (5 lb dart with ½" radius nose, 3 ft drop, 72 deg) | No fracture |

We claim:

1. An array of inertial barriers positioned on a support surface alongside a vehicle roadway, said array comprising:

a plurality of frangible containers arranged along an axis, each of said containers comprising an outer wall and a lower portion;

a plurality of inner cores, each disposed in a respective one of the containers and defining an annular space between the core and the respective outer wall, said annular space defining an average inner diameter and an average outer diameter, wherein the average inner diameter is at least about 20% of the average outer diameter;

a plurality of masses of dispersible material, each disposed in a respective one of the annular spaces such that each of the masses in the entire array of inertial barriers is substantially annular in shape with no more than about 10% of any of the masses in the array extending in an uninterrupted disc across the respective container;

wherein at least some of the inner cores are supported by the lower portion of the respective frangible container.

2. The invention of claim 1 wherein the masses of dispersible material are non-uniform in mass, with less massive ones of the masses situated at one end of the axis and progressively more massive ones of the masses situated progressively farther away from said one end of the axis.

3. The invention of claim 2 wherein each of the dispersible masses comprises sand.

4. The invention of claim 2 wherein each of the frangible containers rests on the support surface freely without tension members secured between the support surface and the container.

5. The array of claim 1 wherein the average inner diameter is at least about 40% of the average outer diameter for each of the annular spaces.

6. The invention of claim 1 wherein first ones of the inner cores are supported by the lower portions of the respective frangible containers and second ones of the inner cores are supported by the outer walls of the respective frangible containers.

7. The invention of claim 6 wherein the dispersible masses in the containers having said first ones of the inner cores are more massive than the dispersible masses in the containers having said second ones of the inner cores.

8. The invention of claim 1 further comprising drainage holes in the frangible containers to drain water from the dispersible masses.

9. The invention of claim 1 wherein each of the inner cores passes completely through the respective dispersible mass from top to bottom such that each of the dispersible masses is annular in configuration.

10. The invention of claim 2 wherein the most massive one of the masses has a weight greater than about 2000 pounds.

11. An array of inertial barriers positioned on a support surface alongside a vehicle roadway, said array comprising:

an array of frangible containers arranged along an axis, each of said containers comprising an outer wall and a lower portion, said containers comprising a plurality of shorter containers at a front end of the axis and at least one taller container at a rear end of the axis;

a plurality of inner cores, each disposed in a respective one of the containers and defining an annular space between the core and the respective outer wall, said annular space defining an average inner diameter and an average outer diameter, wherein the average inner diameter is at least about 20% of the average outer diameter, said inner cores comprising shorter inner cores supported on the outer walls of at least some of the shorter containers and at least one longer inner core supported on the lower portion of the at least one taller container;

a plurality of masses of dispersible material, each disposed in a respective one of the annular spaces such that each of the masses in the entire array of inertial barriers is substantially annular in shape with no more than about 10% of any of the masses in the array extending in an uninterrupted disc across the respective container;

wherein the masses of dispersible material are non-uniform in mass, with less massive ones of the masses situated at the front end of the axis in the shorter containers and progressively more massive ones of the masses situated progressively farther away from the front end of the axis; and wherein each of the frangible containers rests on the support surface freely without tension members secured between the support surface and the containers.

12. The invention of claim 11 wherein each of the dispersible masses comprises sand.

13. The array of claim 11 wherein the average inner diameter is at least about 40% of the average outer diameter for each of the annular spaces.

14. The invention of claim 11 further comprising drainage holes in the frangible containers to drain water from the dispersible masses.

15. The invention of claim 11 wherein each of the inner cores passes completely through the respective dispersible mass from top to bottom such that each of the dispersible masses is annular in configuration.

16. The invention of claim 11 wherein the most massive one of the dispersible masses has a weight greater than about 2000 pounds.

* * * * *